US008322914B2

(12) United States Patent
Bifrare et al.

(10) Patent No.: US 8,322,914 B2
(45) Date of Patent: Dec. 4, 2012

(54) SILICON OVERCOIL BALANCE SPRING

(75) Inventors: Christophe Bifrare, Le Pont (CH); Alain Zaugg, Le Sentier (CH); Pierre Cusin, Villars-Burquin (CH)

(73) Assignee: Montres Breguet SA, L'Abbaye (CH)

( * ) Notice: Subject to any disclaimer, the term of this patent is extended or adjusted under 35 U.S.C. 154(b) by 312 days.

(21) Appl. No.: 12/818,886

(22) Filed: Jun. 18, 2010

(65) Prior Publication Data

US 2011/0310711 A1 Dec. 22, 2011

(51) Int. Cl.
*G04B 17/04* (2006.01)

(52) U.S. Cl. ..... 368/177

(58) Field of Classification Search ..... 368/175–178; 216/2, 33; 29/896.9
See application file for complete search history.

(56) References Cited

U.S. PATENT DOCUMENTS

| | | | | |
|---|---|---|---|---|
| 570,394 | A * | 10/1896 | Griscom | 368/175 |
| 7,950,847 | B2 * | 5/2011 | Zaugg et al. | 368/175 |
| 8,215,828 | B2 * | 7/2012 | Zaugg et al. | 368/175 |
| 2009/0245030 | A1 * | 10/2009 | Buhler et al. | 368/177 |
| 2010/0061192 | A1 | 3/2010 | Hessler et al. | |
| 2010/0110840 | A1 | 5/2010 | Zaugg et al. | |
| 2010/0149927 | A1 * | 6/2010 | Zaugg et al. | 368/177 |

FOREIGN PATENT DOCUMENTS

| | | | |
|---|---|---|---|
| EP | 0 732 635 | A1 | 9/1996 |
| EP | 1 605 323 | A2 | 12/2005 |
| EP | 1 818 736 | A1 | 8/2007 |
| EP | 1 837 722 | A2 | 9/2007 |
| EP | 1 978 421 | A2 | 10/2008 |
| FR | 2 315 714 | | 1/1977 |

* cited by examiner

*Primary Examiner* — Edwin A. Leon
(74) *Attorney, Agent, or Firm* — Griffin & Szipl, P.C.

(57) ABSTRACT

The invention relates to an overcoil balance spring (1) including a hairspring (3) formed in a single silicon part, coaxially with a collet (5), the balance spring including a silicon terminal curve (7) and a silicon elevation device (9) between the outer coil (15) of said hairspring and said terminal curve so as to form a Breguet® overcoil balance spring. According to the invention, the elevation device (9) has a cross-shaped mechanical fastener (17) including at least two opposite arms (12, 12', 14, 14'), which cooperate with clamping means (23, 25) respectively secured to the terminal curve (7) and the outer coil (15) of said hairspring.

23 Claims, 4 Drawing Sheets

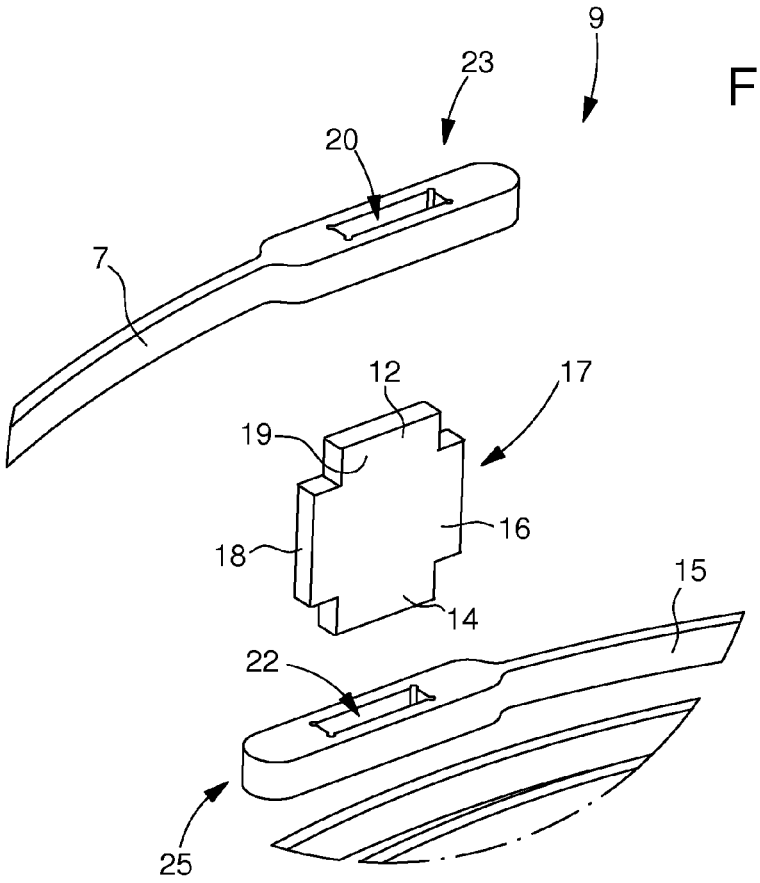
Fig. 2
Fig. 3
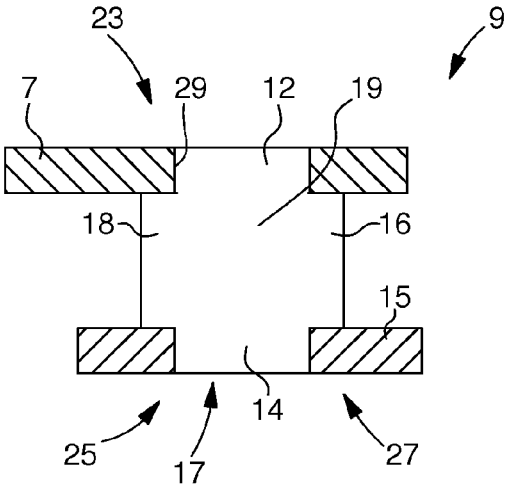

SILICON OVERCOIL BALANCE SPRING

FIELD OF THE INVENTION

The invention relates to an overcoil balance spring and the method of fabricating the same and, more specifically, a silicon-based balance spring of this type.

BACKGROUND OF THE INVENTION

The regulating member of a timepiece generally includes a resonator of the sprung-balance type, comprising an inertia flywheel formed by a balance, and a resilient return torque formed by a balance spring. These members determine the working quality of the timepiece. Indeed, they regulate the working of the movement, i.e. they control the frequency thereof.

It is known to fabricate part of a timepiece in a silicon-based material. Indeed, the use of a micro-machinable material, like silicon, has advantages in terms of fabricating precision, owing to progress in current methods, particularly within the field of electronics. Advantage can also be taken of the very low sensitivity of silicon to magnetism and temperature changes. However, it is currently difficult to make silicon parts with several levels.

SUMMARY OF THE INVENTION

It is an object of the present invention to overcome all or part of the aforecited drawbacks by proposing a silicon overcoil balance spring, whose fabrication is optimised and which allows a reduced variation of rate.

The invention therefore relates to an overcoil balance spring, comprising a hairspring, formed of a single silicon part, coaxially with a collet, the balance spring having a silicon terminal curve and a silicon elevation device between the outer coil of said hairspring and said terminal curve, forming a Breguet® overcoil balance spring, characterized in that the elevation device has a cross-shaped mechanical fastener comprising at least two opposite arms, which cooperate with clamping means, respectively secured to the terminal curve and the outer coil of said hairspring.

Advantageously, an optimised assembly with several planes is made from flat parts formed in a silicon wafer. The assembly is virtually insensitive to magnetism and temperature change and no longer requires the complex adjustment steps currently performed to fabricate this type of balance spring from a metallic strip.

According to other advantageous features of the invention:

- the shoulders between each of said at least two opposite arms and at least one other arm form stop members, for the terminal curve and the outer coil of the hairspring respectively, to ensure predetermined spacing;
- said shoulders between each of said at least two opposite arms and said at least one other arm include recesses to make cooperation easier between said at least two opposite arms and the clamping means;
- the fastener has four arms oriented approximately perpendicularly to each other;
- the thickness of the mechanical fastener is approximately equivalent to the height of the terminal curve and the outer coil of the hairspring;
- each clamping means is formed by a through hole made in a thickened portion respectively in the terminal curve and the hairspring;
- the sections of the holes in the clamping means approximately match those of said two opposite arms;

- each hole has an approximately rectangular section with radiating corners for receiving the fastener more easily;
- each clamping means forms a single part with the terminal curve and the outer coil of said hairspring respectively;
- the elevation device further includes joining means between said mechanical fastener and the clamping means to improve the fixing force of said elevation device;
- the joining means include an adhesive material or a layer of silicon dioxide;
- the balance spring includes at least one silicon dioxide part to make it more mechanically resistant and to adjust its thermo-elastic coefficient;
- the terminal curve is a Phillips curve to improve the concentric development of said balance spring;
- at least one inner coil of the hairspring has a Grossmann curve to improve the concentric development of said balance spring;
- the fastener has recesses for reducing the mass of the elevation device.

Moreover, the invention relates to a timepiece characterized in that it includes an overcoil balance spring in accordance with one of the preceding variants.

Finally, the invention relates to a method of fabricating an overcoil balance spring characterized in that it includes the following steps:

a) etching, in a silicon layer, a first part forming a hairspring, coaxially mounted with a collet, whose outer coil includes clamping means;

b) etching a mechanical fastener in a silicon layer;

c) etching, in a silicon layer, a terminal curve, one end of which includes clamping means;

d) assembling the mechanical fastener to each of the clamping means to form a Breguet® overcoil balance spring.

Advantageously, few steps produce a silicon balance spring with improved precision compared to the complex adjustment steps currently performed to fabricate this type of balance spring from a metallic strip.

According to other advantageous features of the invention:

- after step d), the method further includes step e): oxidising said overcoil balance spring to improve the fixing force of said mechanical fastener;
- prior to or after step d), the method further includes step g): depositing an adhesive material between said mechanical fastener and each of the clamping means and also the final step h): heating said balance spring so as to activate said adhesive material to improve the fixing force of said mechanical fastener;
- prior to step d), the method further includes step i): depositing a metallic material between each of the clamping means and the surfaces of said mechanical fastener that will receive said means so as to drive the clamping means against said fastener in step d);
- steps a), b) and c) are performed at the same time in the same silicon layer;
- after steps a), b) and c), the method further includes step j): oxidising said silicon to improve the mechanical resistance and adjust the thermoelastic coefficient of said overcoil balance spring;
- the method further includes the final step f): heating said overcoil balance spring to improve the fixing force of said mechanical fastener.

BRIEF DESCRIPTION OF THE DRAWINGS

Other features and advantages will appear clearly from the following description, given by way of non-limiting illustration, with reference to the annexed drawings, in which:

FIG. 2 is a partial, perspective, exploded diagram of the elevation device according to the invention;

FIG. 3 is a partial cross-section of the elevation device according to the invention;

DETAILED DESCRIPTION OF PREFERRED EMBODIMENTS

Figure 1:
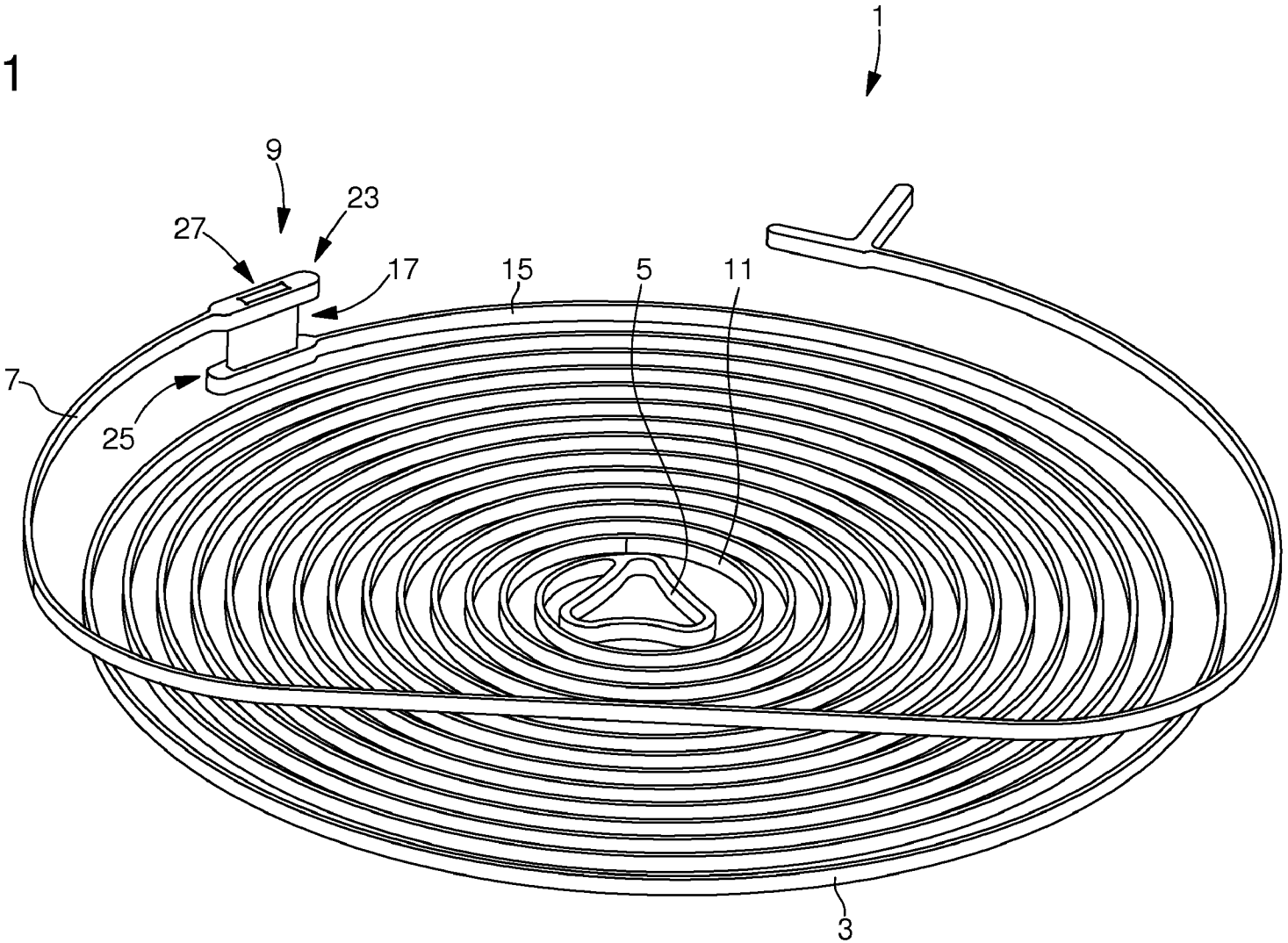
FIG. 1 is a perspective diagram of an overcoil balance spring according to the invention.

The example illustrated in FIGS. 1 to 3 shows an overcoil balance spring generally referenced 1. Balance spring 1 is for assembly in a timepiece in cooperation with a balance to form a resonator. It includes a hairspring 3, a collet 5, a terminal curve 7 and an elevation device 9. Preferably, hairspring 3 and collet 5 form a single part to prevent any imprecision at their interface which could be detrimental to the development symmetry of balance spring 1.

As illustrated in FIG. 1, it can be seen that hairspring 3 preferably has an inner coil 11 that includes a Grossmann curve. A Grossmann curve compensates for the use of a collet 5 by rectifying the inner coil 11 relative to the ideal curve of a perfect Archimedes spiral. FIG. 1 shows that the shape of collet 5 is generally triangular and it can receive a cylindrical balance staff of circular section. Of course, the general shapes of collet 5 and the balance staff may differ without departing from the scope of the invention.

Preferably, in the example illustrated in FIG. 1, terminal curve 7 is a Phillips curve, i.e. a curve that allows concentric development of balance spring 1. Preferably, as illustrated in FIG. 3, the height of terminal curve 7 is identical to the height of hairspring 3.

Because of the geometrical conformity of terminal curve and the hairspring 3-collet 5 assembly explained above, the symmetrical development of balance spring 1 is structurally guaranteed, however the type of fabrication and material used must not damage this development.

In order to guarantee fabrication precision for these curves, but also to make balance spring 1 virtually insensitive to magnetic fields and temperature changes, a silicon-based material can be used. This is a micro-machinable material, i.e. a material that can be fabricated with a precision of less than a micrometer, for example by deep reactive ion etching (DRIE) a crystalline silicon-based wafer.

Of course, silicon is not the only material to possess these features. Other micro-machinable materials can be envisaged, such as, for example, crystallised silica or crystallised alumina.

Preferably, the silicon-based material can also be coated with its oxide to adapt its thermal expansion, but also its thermo-elastic coefficient relative to that of the balance so as to finely adjust the isochronism of the timepiece movement, i.e. to minimise its variation of rate.

In order to make the overcoil balance spring 1, also called a Breguet® overcoil, an elevation device 9 is used for securing outer coil 15 of hairspring 3 to terminal curve 7, located above said hairspring. As illustrated in FIGS. 1 to 3, elevation device 9 includes a mechanical fastener 17 and clamping means 23, 25.

Fastener 17 has a main body 19, which is approximately cross-shaped and includes at least two opposite vertical arms 12, 14. Moreover, in the example of FIGS. 1 to 3, body 19 further includes two opposite horizontal arms 16, 18, with the four arms being distributed at 90° relative to each other. As illustrated in perspective in FIG. 2, the thickness of main body 19 of mechanical fastener 17 is approximately equivalent to the height of terminal curve 7 and outer coil 15 of hairspring 3. Finally, like terminal curve 7 and the hairspring 3-collet 5 assembly, mechanical fastener 17 is also preferably made from a silicon-based material.

According to the invention, clamping means 23, 25 are, preferably, secured respectively to the end of terminal curve 7 and the end of outer coil 15 of hairspring 3. Preferably, each clamping means 23, 25 forms a single part respectively with terminal curve 7 and outer coil 15 of said hairspring.

Clamping means 23, 25 are formed by a through hole 20, 22 made in a thickened portion respectively of terminal curve 7 and hairspring 3. In the example illustrated in FIGS. 1 and 2, holes 20, 22 have approximately rectangular sections, each corner of which is preferably radiating to receive fastener 17 more easily in each hole 20, 22.

Indeed, as illustrated in FIGS. 1 to 3, the two vertical arms 12, 14 are for cooperating, via clamping means 23, 25, with terminal curve 7 and outer coil 15 of hairspring 3. Moreover, the shoulders between each vertical arm 12, 14 and one of the horizontal arms 16, 18 are used, as shown more clearly in FIG. 3, as a spacer by abutting against terminal curve 7 and outer coil 15 of hairspring 3.

Of course, the profiles of clamping means 23, 25 can be different from each other and/or not be uniform over their entire width and/or extend only over part of said width. It is thus possible to envisage that at least one of holes 20, 22 is not rectangular in shape but, for example, circular, elliptical or square. It is also possible for at least one of holes 20, 22 to be open laterally, i.e. radially or tangentially to the balance staff.

Likewise, arms 12, 14, 16, 18 can be in identical pairs or all different from each other and/or not uniform over their entire height and/or extend only over part of said height. Moreover, the number of arms can also differ, i.e. be higher or lower. Finally, it is also possible to envisage at least one of arms 12, 14, 16, 18, or body 19 in general, having recesses for limiting the mass of fastener 17 and, more generally, of elevation device 9, so as to limit its influence on the development of balance spring 1.

Figure 5:
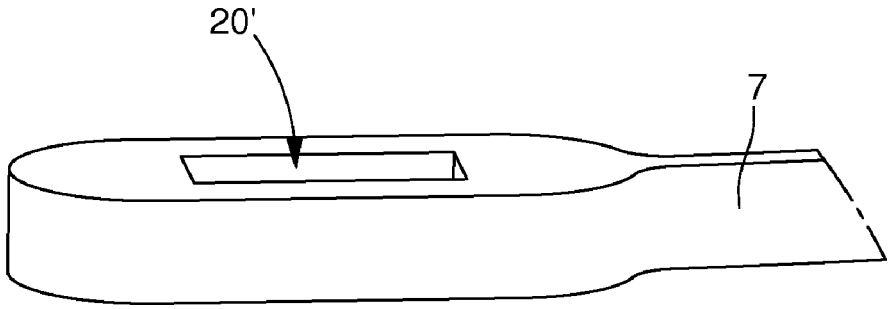
FIG. 5 is a partial, perspective, exploded diagram of the elevation device according to a second embodiment of the invention.
Figure 5:
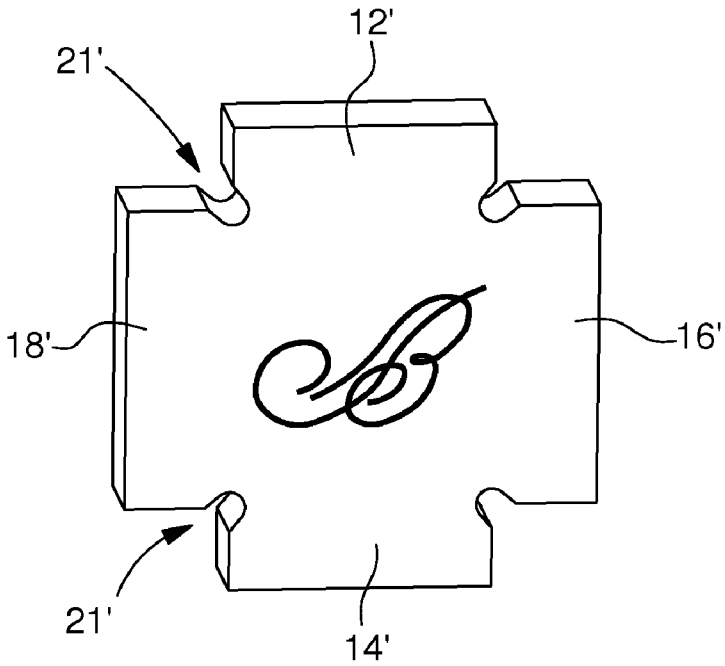

Given the above alternatives, it is clear that the elevation device can include more or fewer arms 12, 14, 16, 18, but also that the rounded portions of holes 20, 22 can alternatively, or in a complementary fashion, be made in the shoulders between arms 12, 14, 16, 18. This particular alternative is shown in FIG. 5. It can be seen that hole 20', which is approximately rectangular and made in terminal curve 7, is no longer rounded at its corners. However, the fastener has recesses 21' between each of arms 12', 14', 16', 18' to make it easier for them to receive arms 12', 14' in their associated holes 20'.

Advantageously, the elevation device can also include joining means 27 for improving the fixing force of elevation device 9. According to the invention, there are a number of possible variants of the joining means depending upon the method used, as explained below. Thus, joining means 27 comprise a layer 29 between mechanical fastener 17 and clamping means 23, 25. This layer 29 can thus include an adhesive material, a metallic material, an oxide or alloy comprising a fusion of the materials used, or even a solder.

Method 31 of fabricating an overcoil balance spring 1 according to the invention will now be explained with reference to FIG. 4. Method 31 mainly includes a step 33 of fabricating components and a step 37 of assembling components. Preferably, method 31 also includes a step 35 of mechanically reinforcing said components and a step 41 of reinforcing the assembly made in step 37.

Figure 4:
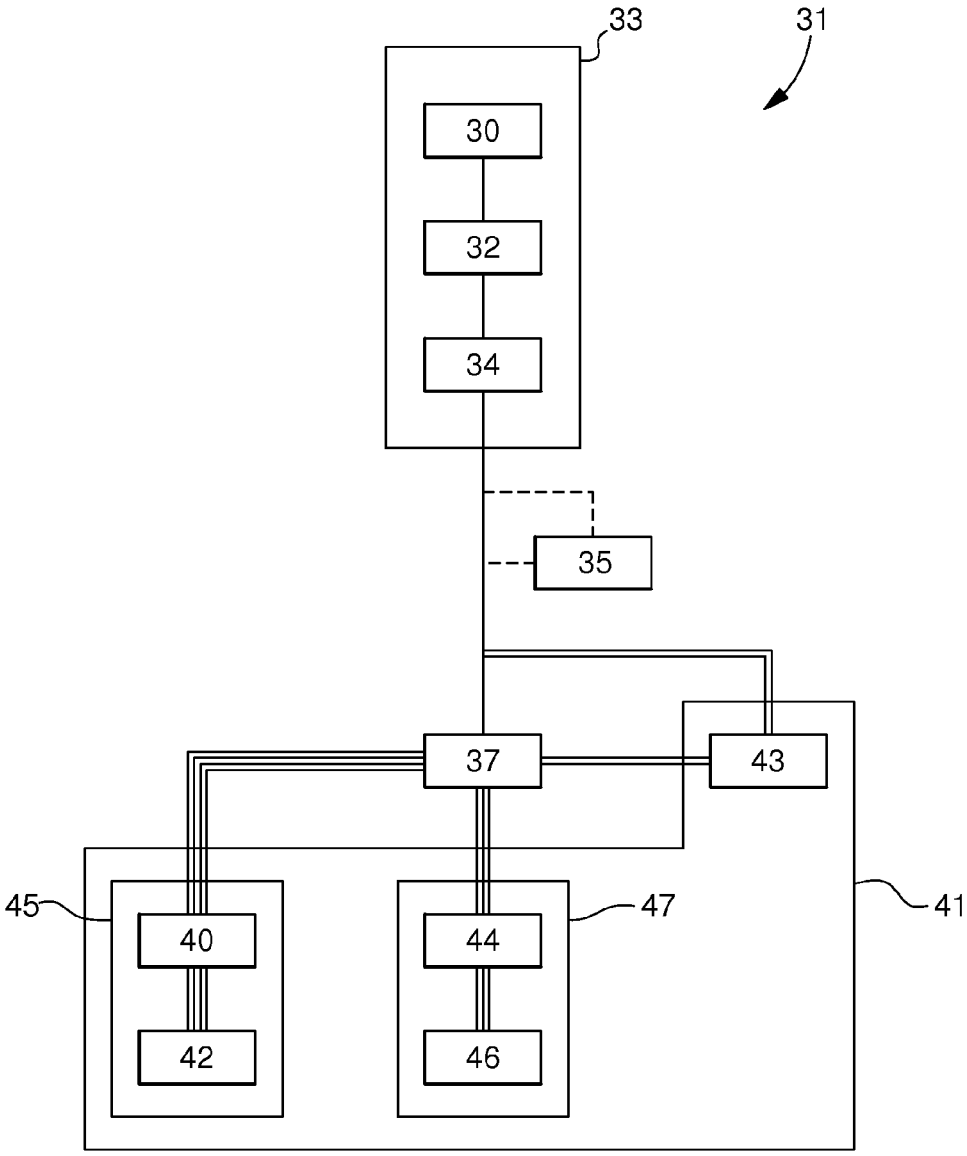
FIG. 4 is a flow diagram of the steps of the fabrication method.

As illustrated in FIG. 4, the first step 33 is for fabricating, in respective steps 30, 32 and 34, the components of overcoil balance spring 1, i.e. the hairspring 3-collet 5-clamping means 25 assembly, the terminal curve 7-clamping means 23 assembly, and fastener 17. Preferably, in order to fabricate said components very precisely, a dry or wet micromachining method will be used. In the example explained above, micromachining can be a DRIE type dry anisotropic etch of a crystalline silicon-based wafer.

Thus, by dry means, phases 30, 32 and 34 may consist, firstly, in coating the wafer with a protective mask, for example by a photolithographic method using a photosensitive resin. Secondly, the wafer is subjected to the anisotropic etch, with only the unprotected parts of the wafer being etched. Finally, in a third phase, the protective mask is removed. It is thus clear that the protective mask directly determines the final shape of the etched components.

Advantageously, it is thus easy to fabricate overcoil balance spring 1 in the dimensions of existing movements or calibres. Thus, advantageously, the movements or calibres can still be fabricated simply by replacing the metal overcoil balance spring usually used with the new silicon-based balance spring, with an improvement in the variation of rate and quality thereof.

Preferably, it is also clear that it is possible to perform phases 30, 32 and 34 of step 33 at the same time on the same wafer. We can therefore conclude that it is possible to etch several duplicates of all the necessary components on said wafer. Consequently, no consecutive order is required for phases 30, 32, 34 and, if they are not performed on the same silicon wafer, they could be carried out in any order.

Second step 37 is for assembling the components etched in step 33, i.e. the hairspring 3-collet 5-clamping means 25 assembly, the terminal curve 7-clamping means 23 assembly and fastener 17. First of all, each required component is detached from the etched plate, for example by breaking bridges of material left between each component and its wafer. Secondly, the three flat components are assembled to form balance spring 1 from three parts. In this second phase, each arm 12, 14 is fitted into the hole 20, 22 at the end of terminal curve 7 and the end of outer coil 15 respectively until it abuts against the shoulders between each vertical arm 12, 14 and one of horizontal arms 16, 18.

Preferably at the end of step 37, the overall height of balance spring 1 is equal to twice the thickness of the etched wafer, representing the terminal curve 7-clamping means 23 assembly and the hairspring 3-collet 5-clamping means 25 assembly, and the length of mechanical fastener 17, which is not covered by said assemblies. Indeed, mechanical fastener 17 is preferably etched in the wafer in the pattern that can be seen in FIG. 3.

As explained above, method 31 can also include a step 35 for reinforcing the etched components. This step may consist in performing an oxidisation to create silicon dioxide at the surface. In the example illustrated in dotted lines in FIG. 4, reinforcement step 35 is performed between etching step 33 and assembly step 37, which allows the entire etched wafer to be oxidised, i.e. all the components at the same time. Of course, step 35 can also be performed after phases 30 and/or 32 and/or 34.

As explained above, method 31 can also include a step 41 for reinforcing the assembly of the etched components. In the example illustrated in FIG. 4, three distinct embodiments can be seen, whose processes are shown with double, triple or quadruple lines.

According to a first embodiment illustrated by a double line in FIG. 4, reinforcing step 41 may consist in depositing, during a phase 43, a layer 29 inside holes 20, 22 of clamping means 23, 25 so as to allow mechanical fastener 17 to be driven into holes 20, 22 at the ends of terminal curve 7 and outer coil 15 of hairspring 3. Thus, this layer 29 could consist of a metallic layer obtained, for example by vapour phase deposition. In fact, the absence of any usable silicon plastic domain may require the use of a layer 29 that can be deformed to prevent clamping means 23, 25 and/or arms 12, 14, 16, 18 breaking during the driving in operation.

Of course, alternatively, layers 29 can also be deposited not inside clamping means 23, 25, but on arms 12, 14. It is thus clear, in the example illustrated by a double line in FIG. 4, that layers 29 must, in the first embodiment, be deposited prior to assembly step 37. However, the deposition in phase 43 may also consist of a solder layer 29. The solder could then be carried out either during assembly step 37 or afterwards.

According to a second embodiment illustrated in quadruple lines in FIG. 4, step 41 of reinforcing the assembly may consist in depositing, in a process 45, an adhesive layer 29 between clamping means 23, 25 and arms 12, 14, so as to improve the fixing force of elevation device 9. Thus a first phase 40 may consist in depositing an adhesive material at the interface of the assembled components and then, preferably, in a second phase 42, in heating the assembly so as to activate said adhesive material. This layer 29 could then consist, for example, of a layer of polymer adhesive material.

Of course, alternatively, deposition phase 40 can also be performed prior to assembly step 37 if the adhesive material is not viscous enough in the non-activated state. The deposition could then be performed inside clamping means 23, 25 and/or on arms 12, 14 prior to assembly step 37 and, preferably, heated after assembly step 37 in phase 42. It is thus clear, in this second embodiment example that, because of their adherence power, layers 29 hold the assembly firmly in place.

According to a third embodiment, illustrated in triple lines in FIG. 4, assembly reinforcing step 41 may consist in forming, in a process 47, a joining layer 29 between clamping means 23, 25 and arms 12, 14 so as to improve the fixing force of elevation device 9.

Thus, a first phase 44 may consist in oxidising the surface of silicon-based balance spring 1 so as to form a silicon dioxide gangue that can better join its assembled components and then, preferably in a second phase 46, in heating the assembly so as to perfect said join.

Of course, alternatively, oxidising phase 44 can also be performed prior to assembly step 37 and replaced by the optional oxidising step 35. Thus, the already oxidised components would be assembled in step 37 and preferably, heated in phase 46 to create a single silicon dioxide layer 29 at the interface between mechanical fastener 17, terminal curve 7 and hairspring 3. It will be noted that a hydrophilisation phase prior to heating phase 46 improves the step of joining the silicon dioxide layers. It is thus clear, in this third embodiment example, that layer 29, like the other two embodiments, reinforces the assembly between mechanical fastener 17, terminal curve 7 and hairspring 3.

Finally, by way of alternative to the third embodiment, one could envisage a process 47 comprising a single step 46 of heating the silicon components assembled in step 37 to weld the stressed interfaces of said components.

What is claimed is:

1. An overcoil balance spring, comprising:

a) a hairspring having an outer coil with a height, formed in a single silicon part, coaxially with a collet, wherein the outer coil includes a first clamping means;

b) a silicon terminal curve having a height, wherein the terminal curve further includes a second clamping means; and c) a silicon elevation device between the outer coil of the hairspring and the terminal curve so as to form a Breguet overcoil balance spring, wherein the elevation device includes a cross-shaped mechanical fastener that includes at least two opposite vertical arms, which cooperate with the first and second clamping means.

2. The balance spring according to claim 1, wherein the mechanical fastener further includes at least two opposite horizontal arms, wherein shoulders between each of the at least two opposite vertical arms and at least one of the horizontal arms form stop members respectively for the terminal curve and the outer coil of the hairspring to ensure a predetermined spacing.

3. The balance spring according to claim 2, wherein the shoulders between each of the at least two opposite vertical arms and the at least one of the horizontal arms include recesses to make cooperation easier between the at least two opposite vertical arms and the first and second clamping means.

4. The balance spring according to claim 1, wherein the fastener has four arms oriented approximately perpendicularly to each other.

5. The balance spring according to claim 1, wherein the mechanical fastener has a thickness approximately equivalent to the height of the terminal curve and the height of the outer coil of the hairspring.

6. The balance spring according to claim 1, wherein each clamping means is formed by a through hole made in a thickened portion respectively of the terminal curve and the hairspring.

7. The balance spring according to claim 6, wherein sections of the holes in the clamping means approximately match those of the two opposite vertical arms.

8. The balance spring according to claim 7, wherein each hole has an approximately rectangular section with radiating corners for receiving the fastener more easily.

9. The balance spring according to claim 1, wherein each clamping means forms a single part respectively with the terminal curve and the outer coil of the hairspring.

10. The balance spring according to claim 1, wherein the elevation device further includes joining means between the mechanical fastener and the first and second clamping means to improve fixing force of the elevation device.

11. The balance spring according to claim 10, wherein the joining means include an adhesive material.

12. The balance spring according to claim 10, wherein the joining means include a layer of silicon dioxide.

13. The balance spring according to claim 1, wherein it includes at least one silicon dioxide part so as to improve mechanical resistance of the balance spring and adjust thermo-elastic coefficient of the balance spring.

14. The balance spring according to claim 1, wherein the terminal curve is a Phillips curve to improve concentric development of the balance spring.

15. The balance spring according to claim 1, wherein at least one inner coil of the hairspring has a Grossmann curve to improve concentric development of the balance spring.

16. The balance spring according to claim 1, wherein the fastener includes recesses for reducing mass of the elevation device.

17. A timepiece wherein it includes an overcoil balance spring in accordance with claim 1.

18. A method of fabricating an overcoil balance spring, wherein it includes the following steps:

a) etching, in a silicon layer, a part forming a hairspring, coaxially mounted with a collet whose outer coil includes a first clamping means;

b) etching a mechanical fastener in a silicon layer, wherein the mechanical fastener is cross-shaped and includes at least two opposite vertical arms;

c) etching, in a silicon layer, a terminal curve whose end includes a second clamping means;

d) forming a silicon elevation device by assembling the mechanical fastener to each of the first and second clamping means so as to form a Breguet overcoil balance spring.

19. The method according to claim 18, wherein, after step d), it further includes the following step:

e) oxidising the overcoil balance spring to improve fixing force of the mechanical fastener.

20. The method according to claim 18, wherein, prior to or after step d), the method further includes the following step:

g) depositing an adhesive material between the mechanical fastener and each of the first and second clamping means.

and wherein the method further includes the following final step:

h) heating the balance spring in order to activate the adhesive material to improve fixing force of the mechanical fastener.

21. The method according to claim 18, wherein, prior to step d), it further includes the following step:

i) depositing a metallic material between each of the first and second clamping means and surfaces of the mechanical fastener that will receive the first and second clamping means so as to drive the first and second clamping means against the mechanical fastener in step d).

22. The method according to claim 18, wherein steps a), b) and c) are performed at the same time in the same silicon layer.

23. The method according to claim 18, wherein it further includes, after steps a), b) and c), the following step:

oxidising at least one silicon layer to improve mechanical resistance and adjust thermoelastic coefficient of the overcoil balance spring.

* * * * *